US005454249A

United States Patent [19]

Kempf et al.

[11] Patent Number: 5,454,249

[45] Date of Patent: Oct. 3, 1995

[54] SPRING TOE FORMING DEVICE AND METHOD

[75] Inventors: Mark A. Kempf, Eagan; Sean M. Frost, Chisago City, both of Minn.

[73] Assignee: Reell Precision Manufacturing Corporation, St. Paul, Minn.

[21] Appl. No.: 342,652

[22] Filed: Nov. 21, 1994

Related U.S. Application Data

[63] Continuation of Ser. No. 901,040, Jun. 19, 1992.

[51] Int. Cl.[6] ..... B21F 35/02

[52] U.S. Cl. ..... 72/130; 72/137; 140/103

[58] Field of Search ..... 72/130, 131, 135, 72/137, 138; 140/103, 104, 71 R

[56] References Cited

U.S. PATENT DOCUMENTS

| | | | |
|---|---|---|---|
| 3,028,904 | 4/1962 | Halvorsen | 72/130 |
| 3,555,863 | 1/1971 | Svensson et al. | 72/12 |
| 3,874,425 | 4/1975 | Guenther | 140/103 |
| 3,906,766 | 9/1975 | Sato | 72/12 |
| 4,112,721 | 9/1978 | Takase et al. | 72/12 |
| 4,296,621 | 10/1981 | Ohdai et al. | 72/137 |
| 4,542,635 | 9/1985 | Matsuoka | 72/137 |
| 4,607,513 | 8/1986 | Russell | 72/137 |
| 4,627,255 | 12/1986 | Archer et al. | 72/10 |
| 4,672,549 | 6/1987 | Saxton | 72/138 |
| 4,680,950 | 7/1987 | Ohdai et al. | 72/130 |
| 4,745,951 | 5/1988 | Guenther | 140/103 |
| 4,821,390 | 4/1989 | Seyler | 29/173 |
| 4,893,491 | 1/1990 | Ohdai et al. | 72/137 |

FOREIGN PATENT DOCUMENTS

| | | | |
|---|---|---|---|
| 56-154238 | 11/1981 | Japan | 140/103 |
| 59-197332 | 11/1984 | Japan | 140/103 |
| 0052726 | 3/1988 | Japan | 140/103 |
| 0052724 | 3/1988 | Japan | 140/103 |
| 63-137519 | 6/1988 | Japan | 72/135 |
| 3-35831 | 2/1991 | Japan | 140/103 |
| 3193231 | 8/1991 | Japan | 140/103 |

*Primary Examiner*—Lowell A. Larson
*Assistant Examiner*—Thomas C. Schoeffler
*Attorney, Agent, or Firm*—Merchant, Gould, Smith, Edell, Welter & Schmidt

[57] ABSTRACT

Apparatus for forming a spring having a spring body and first and second generally axial toes from a wire is disclosed. The apparatus includes mechanisms for feeding the wire from a fixed outlet, wherein the fixed outlet directs the wire in a path; bending a first length of wire fed from the fixed outlet to form a first generally axial toe; bending a second length of wire fed from said fixed outlet to form a spring body; and bending a third length of the wire fed from the fixed outlet to form a second generally axial toe. The wire is then clipped after the formation of the second generally axial toe to separate the spring from a remaining portion of the wire. A method of forming such a spring is also disclosed.

32 Claims, 9 Drawing Sheets

SPRING TOE FORMING DEVICE AND METHOD

This is a continuation of application Ser. No. 07/901,040, filed Jun. 19, 1992.

FIELD OF THE INVENTION

The present invention relates to a spring winding device and method for forming springs. More particularly, the invention relates to a spring winding device and method for forming springs having generally axial toes.

BACKGROUND OF THE INVENTION

Spring winding devices for forming coil springs have been described previously. U.S. Pat. No. 4,893,491 to Ohdai et al., issued Jan. 16, 1990 and assigned to Asahi-Seiki Manufacturing Co., Ltd., describes a spring winding machine and a method for forming coil springs. A wire is fed from a quill against a forming surface. The forming surface is moved to a forward position close to a tip of the quill by a drive system including a cam assembly under numerical control. As the wire is fed from the quill against the forming surface, the wire is bent. By rotating the forming surface, the wire fed from the quill can be bent in different directions such that coil springs of different predetermined forms and sizes are formed. After the coil spring reaches its predetermined form and size, the forming surface is withdrawn from the tip of the quill by the drive system and cam assembly and a cutting tool is moved to a forward position to cut the formed coiled spring away from the wire fed from the quill.

The spring winding device described by Ohdai et al. in the '491 patent provides various cutting and bending tools mounted on a tool mounting frame. These tools can be repositioned relative to the tip of the quill in the same manner as the forming surface. The tool mounting frame includes an opening through which the quill can pass. This allows tools to be mounted and brought in towards the quill and withdrawn from the quill from both front and rear sides of the tool mounting frame. By providing a mechanism for mounting various tools in close proximity to the tip of the quill, a wide variety of bends can be made when forming coil springs. Furthermore, by utilizing numerical control of the apparatus, coil springs can be formed which have a variety of dimensions.

In many applications, for connection of the spring in its particular application, torsion and extension springs require axial toes, e.g., toes generally axial to an axis through the spring. For example, axial toes are used to interface the spring into an electrical clutch used in copy machines which push paper repetitiously and continually. For such an application, the springs are manufactured to strict tolerances dimensionally throughout each and every wrap of the spring. These strict tolerances are extremely important with regard to the toes and the portion of a wrap of the spring connecting the toe to the rest of the spring body. The manufacture of such toes is difficult because of their axial nature. Some springs, for particular applications, require toes having a minimal length, for example, one tenth (0.1) of an inch. This minimal length leads further to the difficulty of manufacture.

Previously, generally axial toes which are formed prior to forming the spring body of a spring have been manufactured utilizing bending tools mounted on a tool mounting frame, such as the frame in Ohdai et al. described above. One bending tool is positioned next to the wire as it is fed from the quill, another bending tool bends the wire across the first bending tool, and yet another tool comes from below to overbend the wire to achieve a 90° bend.

In addition, a toe formed adjacent the spring body after the spring body is formed, previously involved the use of unnecessary additional steps for such manufacture. For example, after one generally axial toe and the spring body were formed, the spring lacking a second generally axial toe was cut and removed from the quill, so that a second generally axial toe could be formed by a machine at a different location. The forming of the second toe at a different machine after the spring body is formed increases the time of manufacture because the spring must be cut from the quill and positioned at the different machine. Because of the difficulty of manufacturing springs having axial toes with precise dimensions utilizing a spring winding device such as that described in Ohdai et al., U.S. Pat. No. 4,893,491, there is a need in the art to produce springs with precise dimensions having generally axial toes and to do so in a shorter period of time than is now possible.

SUMMARY OF THE INVENTION

Accordingly, the present invention provides an apparatus and method for forming a spring having a spring body and at least one toe. The apparatus and method provide for the manufacture of springs having generally axial toes with precise dimensions such that both toes can be formed prior to clipping the spring from a wire fed from a quill without removal of the spring from the spring winding device.

The apparatus of the present invention comprises means for feeding a wire from a fixed outlet, wherein the fixed outlet directs the wire in a path; first bending means bends a first length of the wire fed from the fixed outlet to form a first generally axial toe. A second bending means bends a second length of the wire fed from the fixed outlet to form a spring body and a third means bends a third length of the wire fed from the fixed outlet to form a second generally axial toe. The apparatus further includes means for clipping the wire after the formation of the second generally axial toe.

In another embodiment of the invention, a method for forming a spring is provided. A first length of wire fed from a fixed outlet and directed in a path is bent to form a first generally axial toe. A second length of wire fed from the fixed outlet is formed into a spring body adjacent said first generally axial toe. A third length of wire fed from the fixed outlet is bent to form a second generally axial toe adjacent the spring body. The wire is then clipped after said second generally axial toe is formed.

In another embodiment of the invention, the first generally axial toe is formed by wrapping a portion of the first length of wire about a fixed dimensional core to form a first portion of a first wrap of the spring body with a straight leg extending tangentially therefrom. The first portion of the first wrap is slid into a slotted member such that the straight leg is exposed. A bending member is rotated across the slotted member to bend the straight leg to form the first generally axial toe.

In yet another embodiment of the invention, the second generally axially toe is formed by inserting an elongated blade between a last formed wrap, or a wrap proximate the last formed wrap, of the spring body, and an adjacent wrap. The elongated blade is then rotated to bend the third length of wire across a bending surface to form the second generally axial toe.

These and various other advantages and features of novelty which characterize the present invention are pointed out with particularity in the claims and next formative part hereof. However, for a better understanding of the present invention, its advantages, and other objects obtained by its use, reference should be made to the drawings which form a further part hereof and the accompanying descriptive matter, in which there is illustrated and described a preferred embodiment of the present invention.

BRIEF DESCRIPTION OF THE DRAWINGS

In the drawings, in which like reference numerals indicate corresponding parts of the preferred embodiment of the present invention throughout the several views.

DETAILED DESCRIPTION OF THE PREFERRED EMBODIMENT

Figure 1:
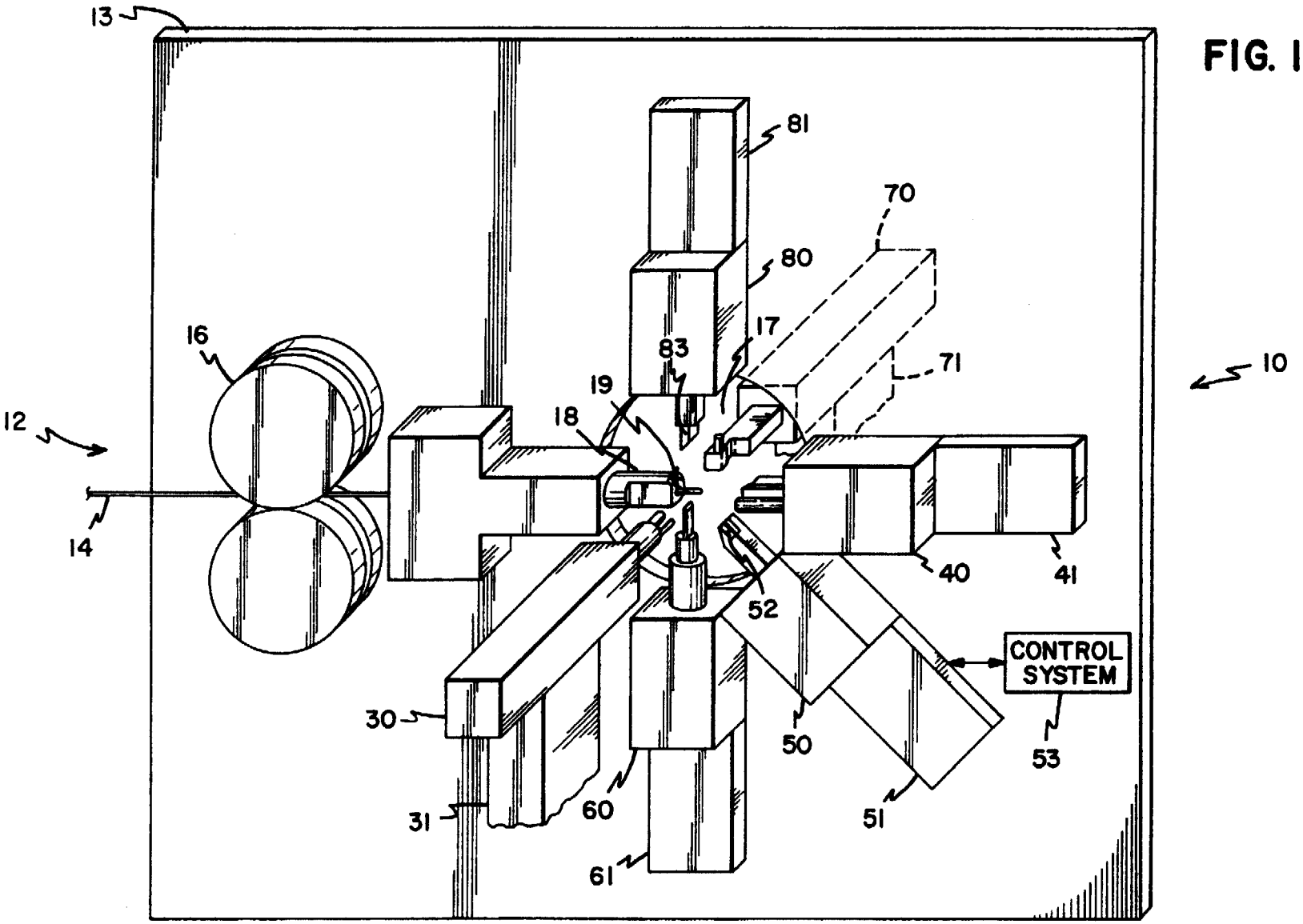
FIG. 1 is a diagrammatical view of the spring forming and toe bending device of the present invention showing various elements used in the forming of a spring with generally axial toes.
Figure 2:
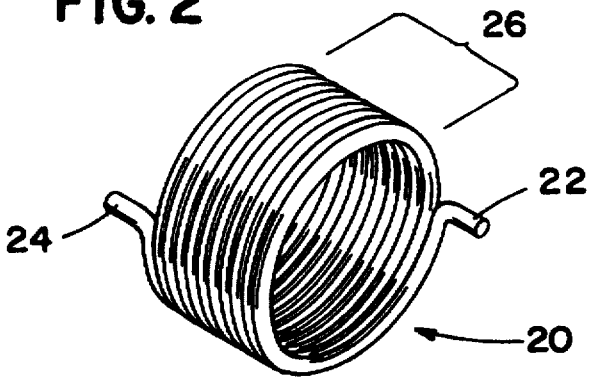
FIGS. 2–5 are a perspective, two side views, and an end view of an exemplary spring formed by the present invention of FIG. 1.
Figure 3:
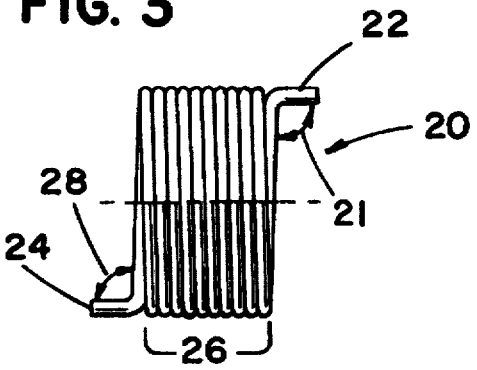
Figure 4:
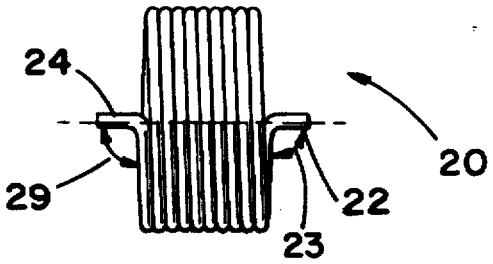
Figure 5:
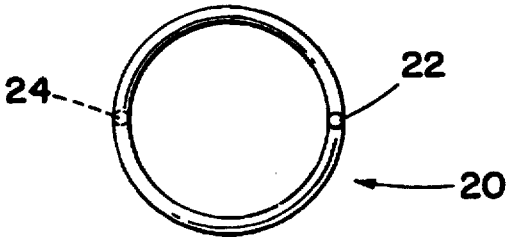

The spring forming and toe bending device of the present invention will be described generally with reference to FIGS. 1–7. FIG. 1 shows in diagrammatical form the spring forming and toe bending device 10. The spring forming and toe bending device 10 includes a standard numerical controlled spring winding machine 12, having a vertical standing tool mounting frame 13. The standard numerical controlled spring winding machine 12 has a quill 18 for feeding a wire 14 through feed rollers 16 and from a fixed outlet 19. The wire 14 is directed in a path by the fixed outlet 19. Various tools are mounted on the tool mounting frame 13 to form the spring as shown in FIGS. 2–5. The spring 20 includes a spring body 26 and a first toe 22 and second toe 24 adjacent thereto.

Figure 6:
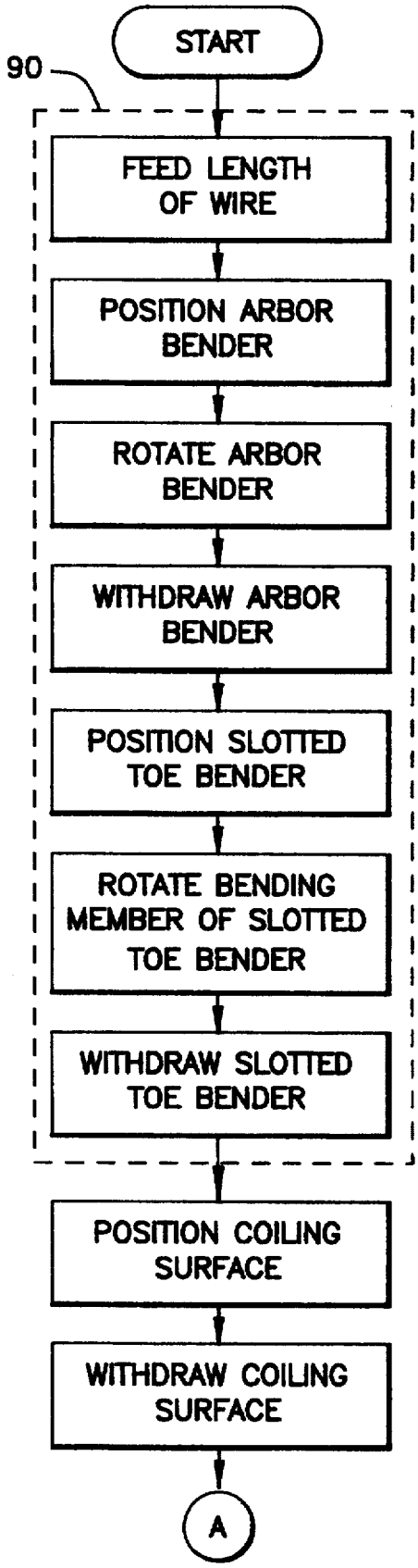
FIGS. 6 and 7 are a flow diagram of a steps for a spring winding device in forming a spring as shown in FIGS. 2–5 of the present invention.
Figure 7:
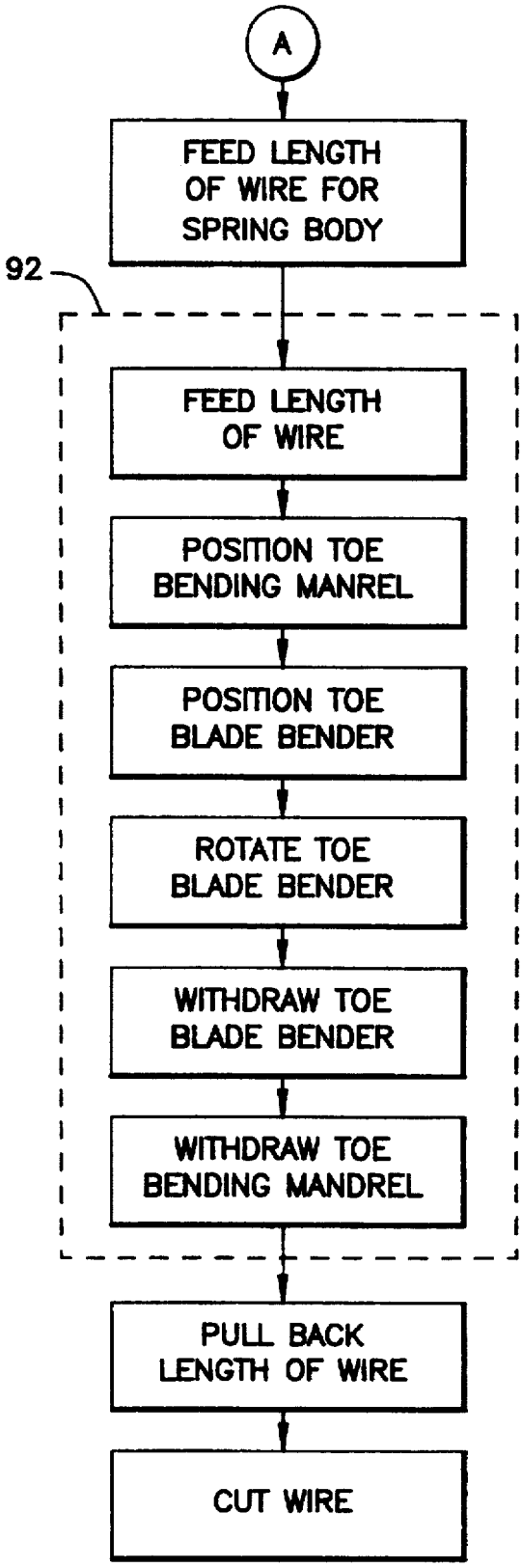

As shown in the flow diagrams of FIGS. 6 and 7, the first toe is formed by the steps of block 90 and the second toe is formed by the steps of block 92. The overall control of forming the first toe 22, the spring body 26, and the second toe 24, and in addition the cutting of the wire after formation of the second toe, are shown in the flow diagram of FIGS. 6 and 7. Such steps are controlled by the standard numerical controlled spring winding machine 12 which shall be discussed in further detail below. The first toe 22 is formed by feeding a length of wire 14 from fixed outlet 19, wrapping a first quarter wrap with a straight leg extending therefrom utilizing arbor bender 30, and bending the straight leg extending from the first quarter wrap utilizing slotted toe bender 40. The spring body 26 is then formed by bending the wire 14 fed from the fixed outlet 19 as it is directed against the coiling surface 52 of coiling tool 50. After the spring body 26 is formed, an additional length of wire 14 is fed from fixed outlet 19. The second toe 24 is then formed by engaging the spring body 26 with toe blade bender 60 and rotating the toe blade bender 60 such that the additional length of wire is bent across a bending surface of toe bending mandrel 70. The wire 14 fed from fixed outlet 19 is then cut by cutting or clipping tool 80 after formation of the second axial toe 24.

The spring forming and toe bending device 10 will further be described in detail with reference to FIGS. 1–7 and FIGS. 8–23 which show details of various tools mounted upon tool mounting frame 13 of FIG. 1. The spring forming and toe bending device 10 of FIG. 1 includes a standard spring winding machine 12 having vertical standing tool mounting frame 13. The tool mounting frame 13 includes opening 17, such that tools can be positioned entirely around the quill 18, including the rear of mounting frame 13. The standard numerical controlled spring winding machine 12 is preferably an Asahi-Seiki NTF2, manufactured by Asahi-Seiki Manufacturing Company, Limited, of Aichi, Japan. The standard spring winding machine 12 is a numerical controlled machine which controls the winding of springs. A machine like the NTF2 is described in U.S. Pat. No. 4,893,491 to Ohdai et al. (assigned to Asahi-Seiki Manufacturing Company), which is incorporated herein by reference.

The numerically controlled spring winding machine 12 includes a quill 18 having a fixed outlet 19 through which feed rollers 16 feed a wire 14 in a path therefrom. Under numerical control various tools are brought into particular positions with respect to the fixed outlet 19 to form spring 20. As shown in FIG. 1, the spring forming and toe bending device 10 includes various tools mounted on the tool mounting frame 13 with their positions numerically controlled by spring winding machine 12 as generally set forth in the flow diagrams of FIGS. 6 and 7 to form the spring 20.

The various tools, which are each operatively mounted to mounting frame 13 and connected for operation with spring winding machine 12 include arbor bender 30, slotted toe bender 40, coiling tool 50, toe blade bender 60, toe bending mandrel 70 and clipping tool 80. Arbor bender 30 is operatively mounted such that its arbor core 34 (FIG. 8) is transverse to the vertical standing tool mounting frame 13 and can be positioned with respect to the fixed outlet 19 of quill 18 by pneumatic drive assembly 31 as is generally known in the art. Slotted toe bender tool 40 is located directly across from fixed outlet 19 and is moved into position and withdrawn from a position with respect to the fixed outlet 19 by drive and cam assembly 41. The coiling surface 52 is positioned such as to bend the wire 14 directed in a path from the fixed outlet 19 to form the spring body 26 of spring 20. The coiling tool 50 is moved into position by a drive and cam assembly 51. Toe blade bender 60 is located generally below the fixed outlet 19 such that a blade of toe blade bender 60 can be inserted into a last formed wrap of the spring body 26 of spring 20. The toe blade bender 60 is positioned with respect to the fixed outlet 19 by drive and cam assembly 61. Toe bending mandrel 70 is brought into position with respect to fixed outlet 19 by cam and drive assembly 71 through the opening 17 of tool mounting frame 13. Cutting or clipping tool 80 is utilized to cut the wire 14 after formation of the second toe 24 of spring 20 and is brought into position to perform such function by drive and cam assembly 81. The drive and cam assemblies which position the tools with respect to the fixed outlet 19 are generally known in the art and commonly used in the mounting of tools on spring winding devices. General description concerning similar drive and cam assemblies utilized to mount tools is described in Ohdai et al., U.S. Pat. No. 4,893,491, previously incorporated herein by reference.

Figure 9:
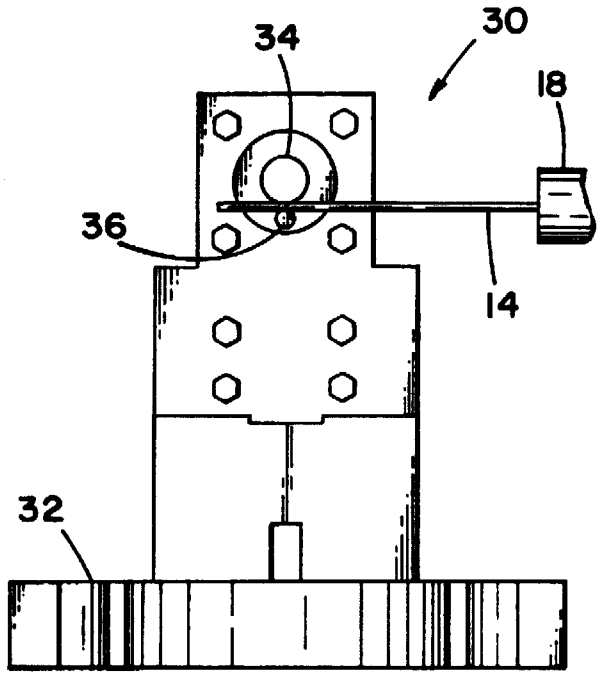
FIG. 9 is an end view of the arbor bender of FIG. 8 prior to rotation of the arbor core.
Figure 8:
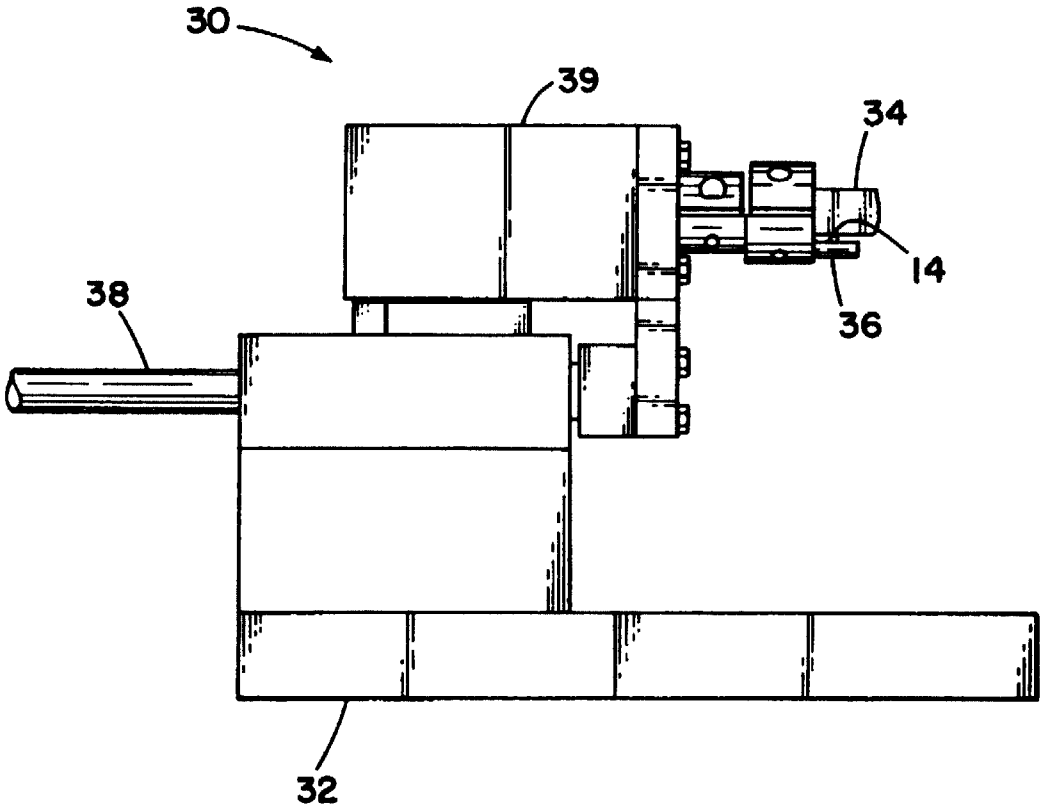
FIG. 8 is a side view of an arbor bender tool shown in FIG. 1 looking towards the face of the quill.
Figure 10:
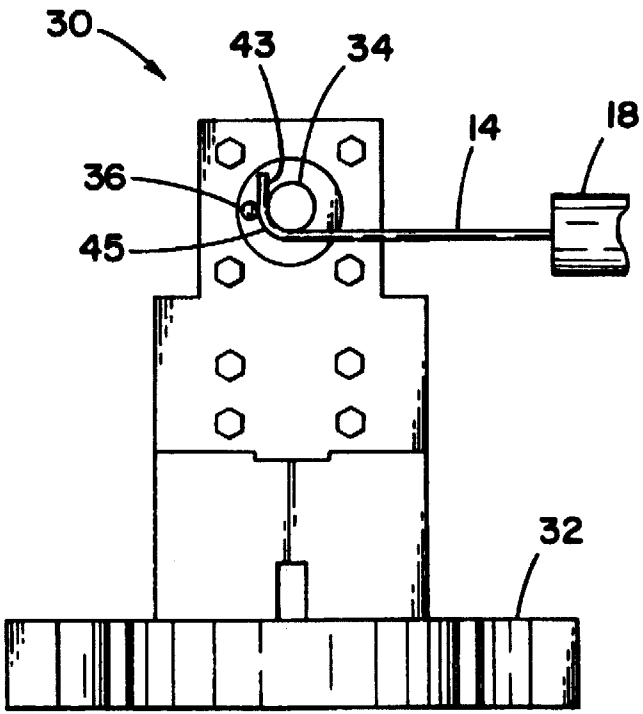
FIG. 10 is an end view of the arbor bender of FIG. 8 after the arbor core is rotated.

These various tools of the spring forming and toe bending device 10 are utilized to form spring 20 having a first axial toe 22 and second axial toe 24. As the steps of forming spring 20 are described, in conjunction with FIGS. 6 and 7, the device for performing such steps will also be described. To begin forming spring 20, a first axial toe 22 is formed under numerical control of the spring winding machine 12 according to the steps of block 90. A predetermined length of wire 14 is fed from fixed outlet 19 by feed rollers 16 in a path therefrom. Two tools are utilized to form a first quarter wrap 45 of the spring body and the first axial toe 22; the tools being arbor bender 30 and slotted toe bender 40. Arbor bender 30, as shown in FIGS. 8–10, forms a first quarter wrap 45 with a straight leg extending therefrom. In the preferred embodiment, the straight leg is approximately one tenth (0.1) of an inch. It will be appreciated that any practical length can be provided, and that such preferred length is not limiting of the invention. The arbor bender 30 includes an arbor bender support 32 for mounting the tool to tool mounting frame 13, arbor core 34, and a catch pin 36. Rotary actuator 39 and pneumatic slide 38 of pneumatic drive assembly 31 are operatively connected to the arbor core 34 and catch pin 36 to provide rotation thereof and position the arbor core 34 and pin 36 with respect to fixed outlet 19. Such rotation of tools by means of air, hydraulics, etc., are generally known to those skilled in the art.

The arbor bender 30 is positioned by the pneumatic drive assembly 31 under numerical control of the spring winding machine 12 such that the predetermined length of wire fed from the fixed outlet 19 is fed between the arbor core 34 and catch pin 36 as shown in FIGS. 8 and 9. Both FIG. 8 and FIG. 9 show the position of wire 14 prior to the rotation of the arbor core 34 and catch pin 36. FIG. 10 shows an end view of the arbor bender 30 after the arbor core 34 and catch pin 36 are rotated, preferably, about 90°. The rotation is controlled under numerical control of the spring winding machine by turning on and off the rotary cylinder 39 operatively connected for rotation of the arbor core 34 and catch pin 36. The amount of wire 14 fed from fixed outlet 19 and the degree of rotation determines the length of the straight leg and the angle 21 of the toe with respect to an axis through the spring body 26. A rotation of the arbor core greater than or less than 90° will lead to formation of an axial toe 22 which will either lean into or away from the axis through the spring body 26. The catch pin 36 engages the wire 14 as the rotation of the arbor core 34 and catch pin 36 occurs so as to wrap the wire 14 around the arbor core 34 and form the quarter wrap 45 and straight leg 43.

Previously in spring winding machines, the first core wrap was formed with the use of a coiling tool, such as coiling tool 50, whereby the coiling surface 52 was brought forward with respect to fixed outlet 19 and the wire 14 was directed against the coiling surface to form a first quarter wrap. Because dimensional characteristics of the first quarter wrap are crucial in certain applications for springs, and because of the small dimension of the first axial toe 22 of spring 20, which when bent may produce error in an ordinarily formed first quarter wrap, utilization of an arbor bender 30 of the present invention produces a first quarter wrap and straight leg of precise dimension. The dimension of the first quarter wrap is determined by the physical characteristics of arbor core 34. In order to keep the physical dimensions of the first quarter wrap within strict tolerances during the bending of the straight leg 43 to form the first axial toe 22, the second tool, the slotted toe bender 40, is provided.

Figure 11:
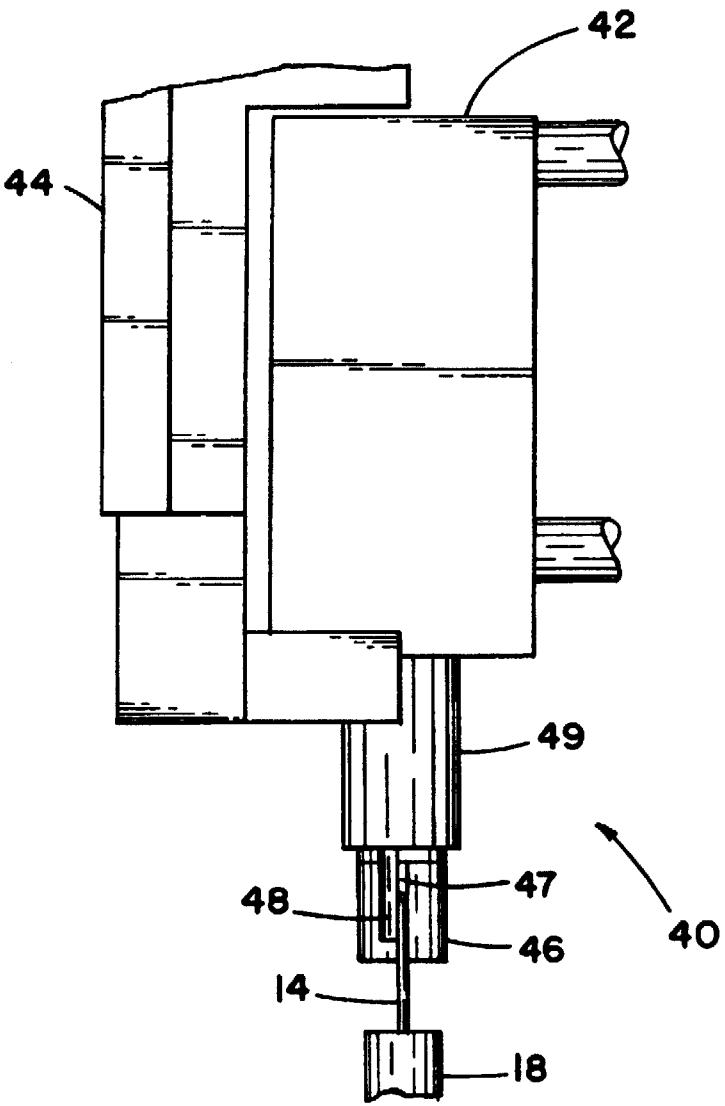
FIG. 11 is a plan view of a slotted toe bender of FIG. 1 prior to rotation of a rotational member thereof.
Figure 13:
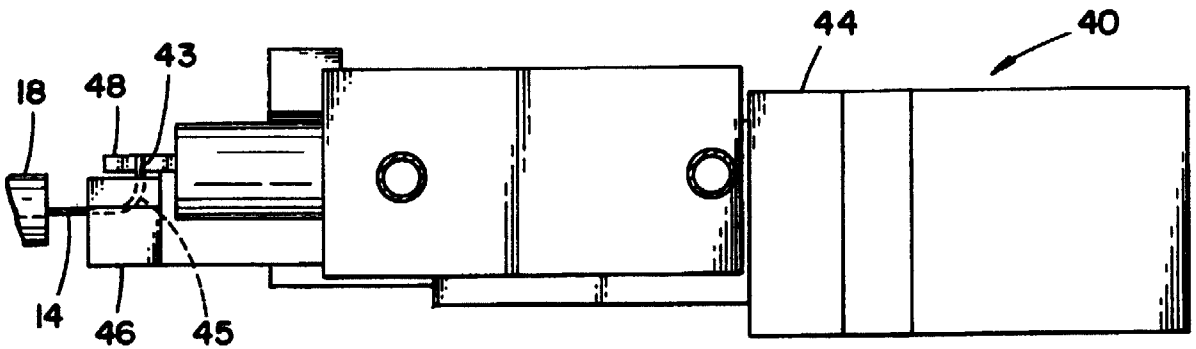
FIG. 13 is a side view of the slotted toe bender of FIG. 11 prior to such rotation.
Figure 12:
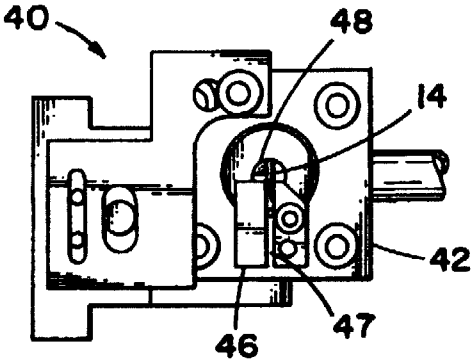
FIG. 12 is an end view of the slotted toe bender of FIG. 11 prior to rotation of the rotational member thereof.

The slotted toe bender 40 is positioned with respect to the fixed outlet 19 after the arbor bender 30 has completed its process resulting in a first quarter wrap 45 and straight leg 43 and is withdrawn from the fixed outlet 19 by pneumatic drive assembly 31 under numerical control. The slotted toe bender 40 is illustrated in detail in FIGS. 11–15. FIG. 11 shows a plan view, looking down from the top of the vertical standing mounting frame 13, of the slotted toe bender 40 with the quarter wrap 45 and straight leg 43 formed by arbor bender 30 in a slot 47 of slotted member 46, and prior to the forming of the first axial toe 22. FIG. 12 shows an end view of the slotted toe bender, looking from the quill, of the quarter wrap 45 and straight leg 43 inserted in slot 47 also prior to forming of the first toe 22. FIG. 13 shows a side view of the same structure. The slotted toe bender 40 includes a support 44 for mounting the slotted toe bender 40 to tool mounting frame 13. A rotary air cylinder 42 is operatively connected to a rotating member 48 to provide rotation of the member 48 to bend the straight leg 43 as discussed below.

The slotted toe bender 40 is positioned by drive and cam assembly 41 such that the quarter wrap 45 and straight leg 43 are positioned in slot 47 of the slotted member 46. The straight leg 43 is positioned in the slotted member 46 such that the straight leg 43 is exposed and can be bent by rotating member 48 to form the first axial toe 22. The rotating member 48 is a quarter section of a cylinder mounted on an additional rotating member 49. Rotation of the rotating member 49 is accomplished under numerical control by turning on and off an air cylinder 42 operatively connected thereto. Accomplishment of such rotation is readily known in the art as indicated previously.

Figure 15:
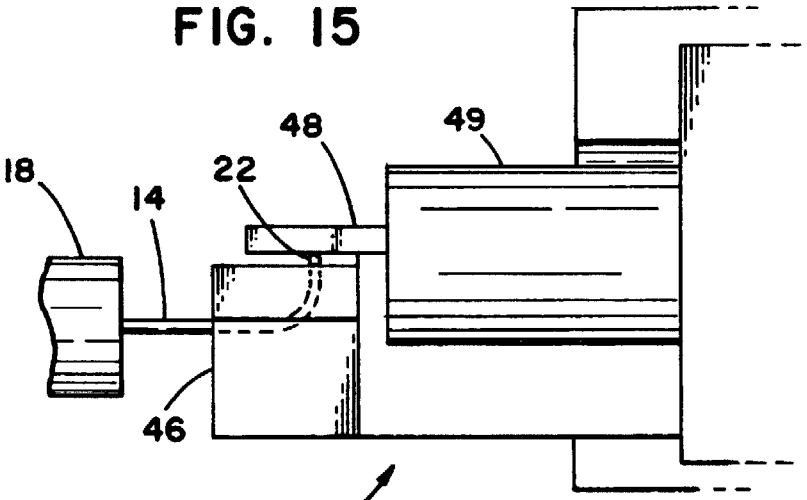
FIG. 15 is a side view of the slotted toe bender of FIG. 11 after rotation of such rotational member.
Figure 14:
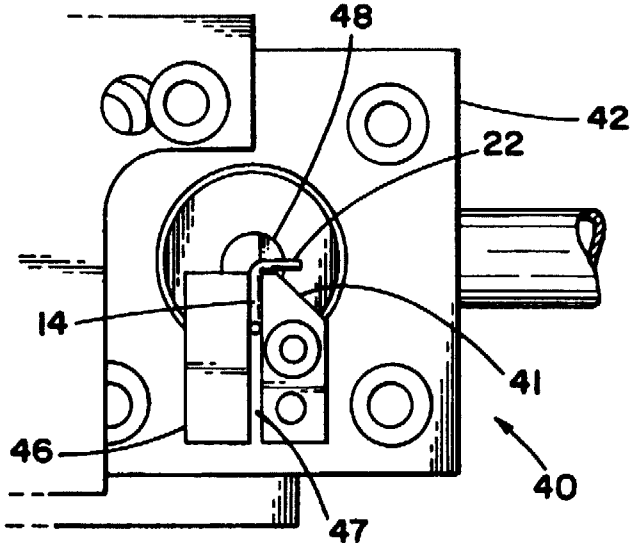
FIG. 14 is an end view of the slotted toe bender of FIG. 11 after rotation of the rotational member thereof.

FIG. 14 and FIG. 15 show an end view and side view of the slotted toe bender 40 after the rotational member 48 has been rotated and the first axial toe 22 is formed. The distance of rotation of the rotating member 48 determines the angle 23 of the axial toe 22 with respect to a wrap of the spring body 26. Slanted portion 41 of the slotted member 46 allows the axial toe to be bent beyond 90° and, of course, the axial toe may be bent less than 90°. In the preferred embodiment, the axial toe 22 is preferably bent about 90°. To achieve such a bend, the straight leg is overbent to about 110° and due to the elastic properties of the wire springs back to about 90°. By having the first quarter wrap positioned within the slot 47 of slotted member 46, the dimensions of the first quarter wrap are maintained during the bending of the straight leg 43. After the straight leg 43 is bent to form the first axial toe 22, the slotted toe bender 40 is withdrawn from the fixed outlet 19 by drive and cam assembly 41. This completes the formation of the first axial toe 22.

At completion of such toe and after withdrawal of slotted toe bender 40, the coiling surface 52 of coiling tool 50 is positioned with respect to the fixed outlet 19 by drive and cam assembly 51 to form spring body 26 of spring 20. The spring body can be formed in a number of ways. For example, an arbor tool can be used to construct the plurality of wraps of the spring body 26. In addition, a coiling surface such as shown in FIG. 1, or multiple coiling surfaces as known in the art can be utilized to form the plurality of wraps of the spring body. In the preferred embodiment, the plurality of wraps are formed in the manner described in a commonly owned pending U.S. patent application, U.S. Ser. No. 07/865,353, assigned to Reell Precision Manufacturing Corporation, entitled "ADAPTIVE SPRING WINDING DEVICE AND METHOD", which is incorporated herein by reference.

As described in the commonly owned application, U.S. Ser. No. 07/865,353, physical characteristics of the plurality of wraps of the spring body 26 are controlled in the following manner. The spring winding machine feeds a wire from fixed outlet 19 against a coiling surface 52 to bend the wire to form a predetermined number of wraps. The physical characteristics are precisely maintained from wrap to wrap and from spring to spring by means of a system for controlling the location of the coiling surface 52. The location of the coiling surface is adjusted in response to signals produced by a detector monitoring the wire downstream of the fixed outlet 19. The signals being indicative of physical characteristics of the deflected wire.

The control system 53 includes a computer (not shown), preferably a Compaq 386s, 20 megahertz, which receives signals from an LVDT (not shown) positioned with respect to the wraps of the spring body 26 being formed. The LVDT, in the preferred embodiment, is a Schaevitz DTR-451 digital transducer with a PCA-499 probe. In the preferred embodiment, the LVDT is positioned to detect the position of the wire as it is deflected from the coiling surface 52 while the coil spring 20 is being formed. The detection of the wire 14 is made relative to the fixed outlet 19 and output signals indicative of a physical characteristic of the deflected wire are produced. The position of the wire 14 can be detected anywhere downstream from the fixed outlet 19, whether prior or after being deflected by coiling surface 52. In the preferred embodiment, the LVDT is positioned to detect the inner diameter of coil spring 20 after the wire 14 is deflected from coiling surface 52 to form part of the spring body. The inner diameter is thus the parameter to be controlled for dimensional variation. The inner diameter is not the only parameter which can be controlled by the control system utilizing position detection of the LVDT. Measurements for controlling the outer diameter can also be performed.

Analog signals which are proportional to the change in distance measured by the probe of the LVDT are provided to input/output circuitry (not shown), whereby the analog signals from the LVDT are digitized by an analog to digital converter (not shown). A set reference point for such measurements is known and the LVDT indicates that the probe of the LVDT is at a different point by means of the digitized signals applied to the computer under control of certain software. A standard proportional integral differential control algorithm (PID) is used as the control algorithm to general control signals as a function of the digitized analog signals from the LVDT. These digital control signals are applied to an input/output circuit by the computer and are converted to an analog signal by a digital to analog converter (not shown). The analog control signals are then applied to an amplifier (not shown) to be amplified for driving a piezoelectric translator (not shown) operatively mounted on a piezo slide (not shown) to micro-position the coiling surface 52 to substantially uniformly maintain the inner diameter of the spring 20 as the spring is formed. In a preferred embodiment, the amplifier is Kepco BOP 100-4M power supply.

Position detection performed by the LVDT, indicative of changes in the parameters of the spring can be performed by other devices. A laser gauge, an inductive probe and any other way of detecting the position of the wire indicative of parameters of the spring as the spring is being formed can be utilized.

The piezoelectric translator is operatively mounted on a piezo slide to micro-position the coiling surface 52. In the preferred embodiment, the piezoelectric translator is a Physik Instrumente GmbH and Company 844.60 LVPZ piezoelectric actuator. The piezoelectric translator is capable of traveling approximately 0.0035 of an inch; therefore, it micro-positions, in contrast to gross positions, the coiling surface 52 for controlling the deflection of wire such that the parameters being controlled in response to position detection by LVDT is substantially uniformly maintained during the formation of spring 20.

Figure 17:
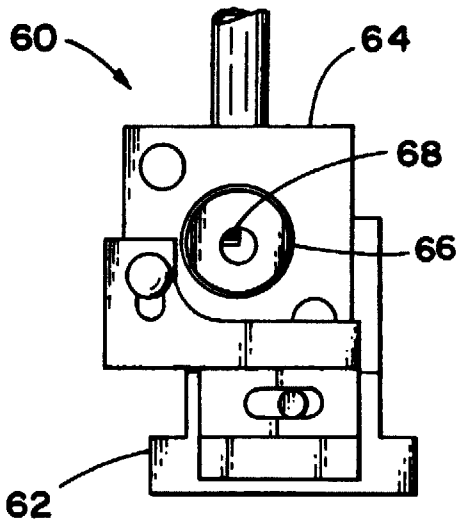
FIG. 17 is a plan view of the toe blade bender of FIG. 16 shown without a spring engaged thereon.
Figure 16:
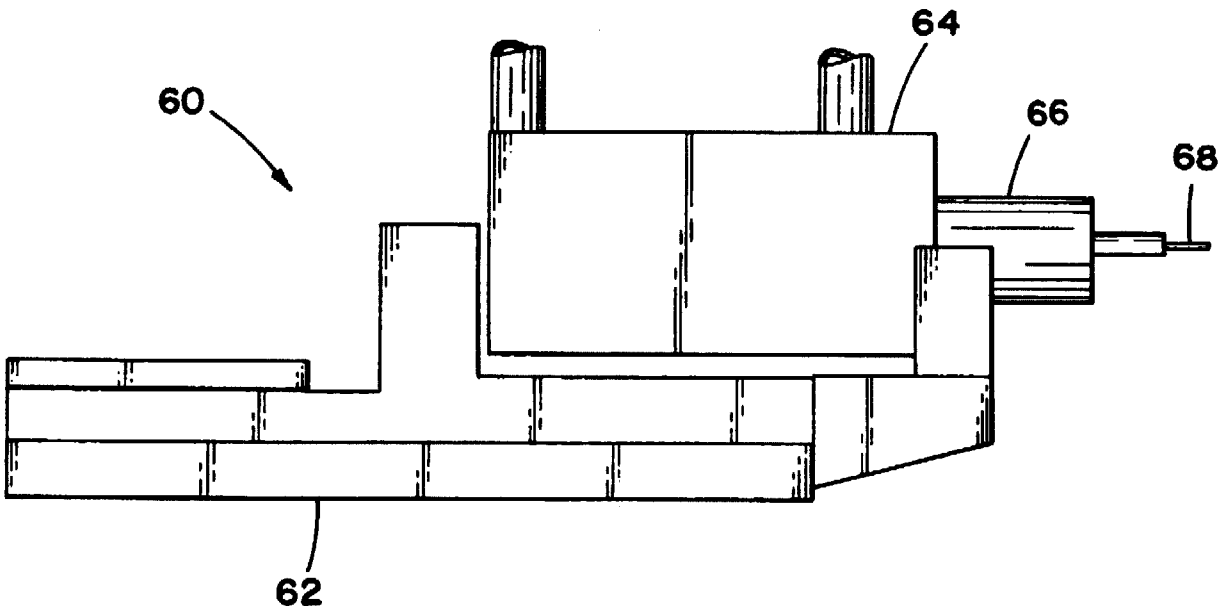
FIG. 16 is a side view of a toe blade bender of FIG. 1.
Figure 20:
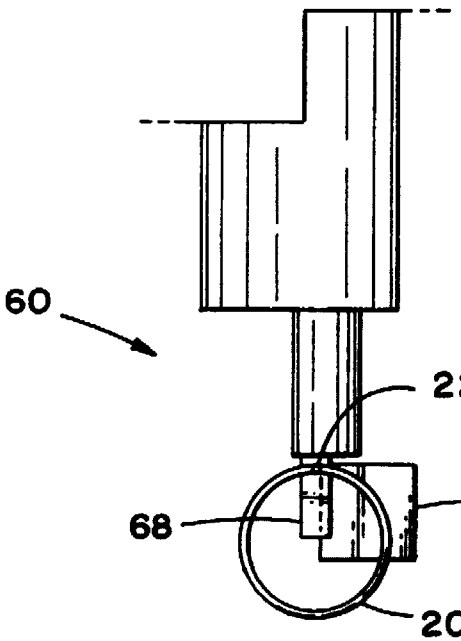
FIG. 20 is an additional side view of the toe blade bender of FIG. 16 with a spring engaged thereon and prior to rotation of the blade thereof.
Figure 19:
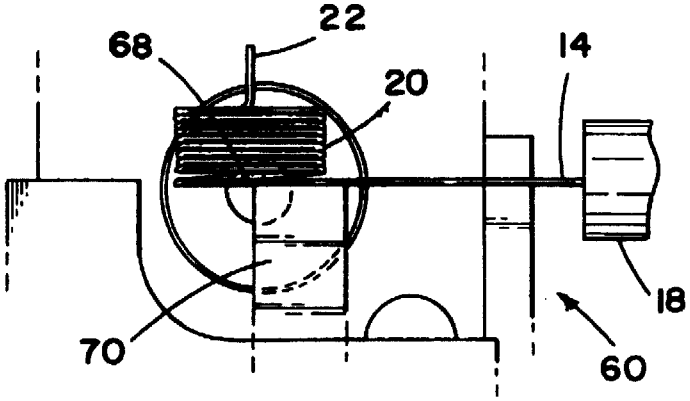
FIG. 19 is a plan view of the toe blade bender of FIG. 16 with a spring engaged thereon prior to rotation of the blade thereof.
Figure 18:
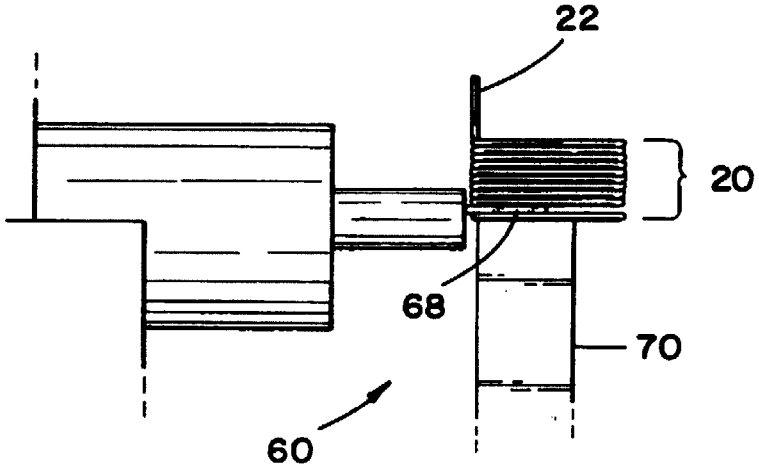
FIG. 18 is a side view of the toe blade bender of FIG. 16 with a spring engaged thereon and prior to rotation of a blade thereof.

After formation of the spring body is completed, the coiling surface 52 is withdrawn under numerical control and a second axial toe 24 of spring 20 is formed in accordance with the steps of block 92 of FIG. 7. Also under numerical control of the spring winding machine 12, two tools, the toe blade bender 60 and toe bending mandrel 70 are utilized to form the second axial toe 24. As shown in FIG. 7, after the last wrap of spring body 26 of spring 20 is formed, feed rollers 16 feed a predetermined length of wire from the fixed outlet 19. The toe blade bender 60 is then positioned by drive and cam assembly 61 such that a blade 68 of the toe blade bender 60 can be inserted between the last formed wrap of the spring body 26 and an adjacent wrap. FIGS. 16 and 17 show the toe blade bender 60 prior to insertion of blade 68 into spring body 26. FIGS. 16 and 17 are a side view and a plan view of the toe blade bender, respectively. FIGS. 18–20 show the toe blade bender 60 after the blade 68 has been inserted into spring body 26. FIGS. 18–20 are a side view, a plan view and another side view, respectively.

The toe blade bender 60 includes a rotational member 66 connected to the blade 68. An air cylinder 64 is operatively connected to rotational member 66 to provide for rotation of the blade 68. The toe blade bender further includes a support 62 for attachment to tool mounting frame 13 by means of drive and cam assembly 31.

Figure 21:
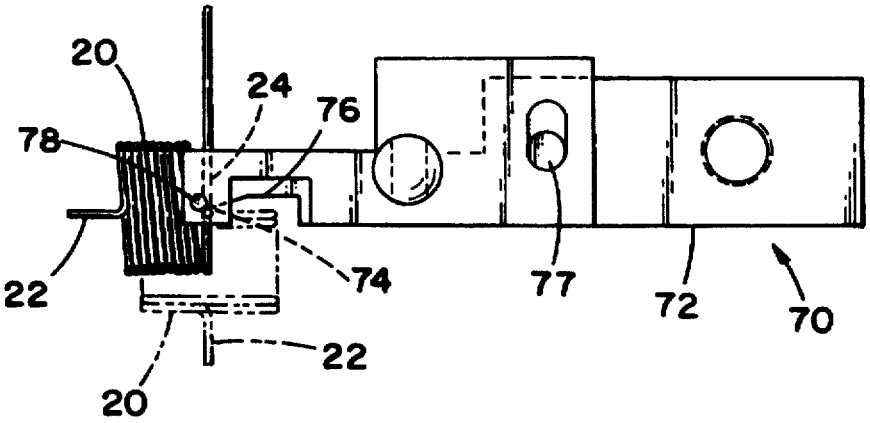
FIG. 21 is a plan view of a bending mandrel of FIG. 1 showing the position of the spring prior to and after rotation (in broken lines) of the blade of the toe blade bender of FIG. 16.
Figure 22:
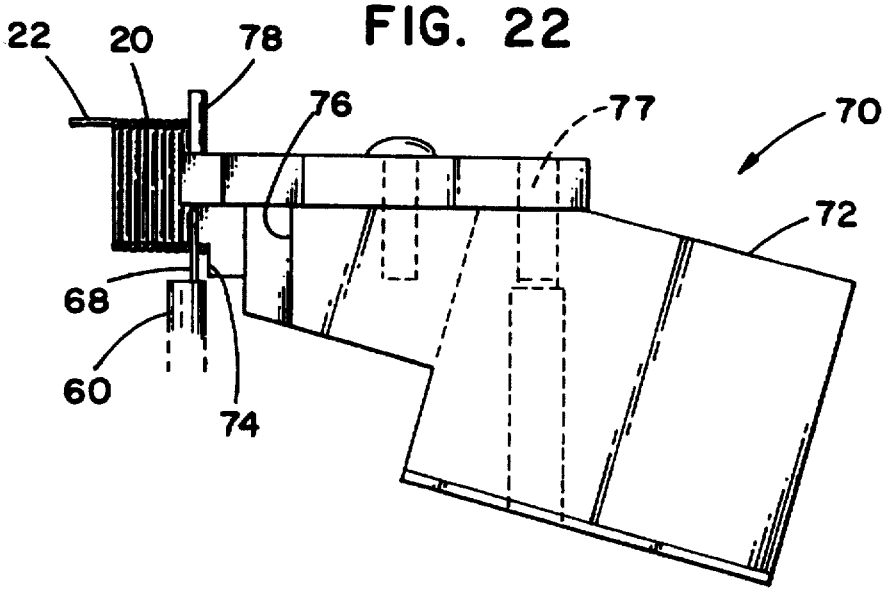
FIG. 22 is a side view of the bending mandrel of FIG. 21 showing the position of the spring and toe blade bender of FIG. 16 with relation to the bending mandrel.
Figure 23:
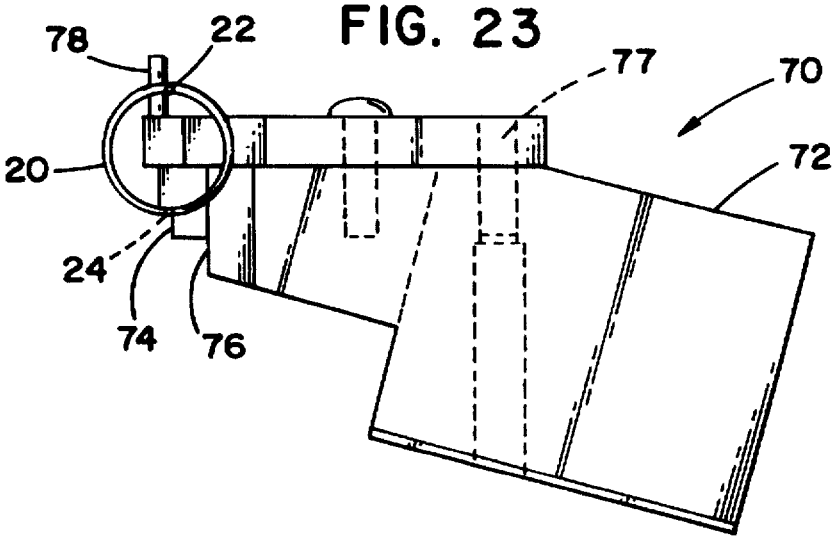
FIG. 23 is a side view of the bending mandrel of FIG. 21 after rotation of the blade of the toe blade bender of FIG. 16.

Prior to positioning the toe blade bender 60 such that blade 68 is inserted between the last wrap of the spring body 26 and an adjacent wrap, toe bending mandrel 70 is positioned at a location with respect to fixed outlet 19 by drive and cam assembly 71. The bending mandrel 70 is shown in detail in FIGS. 21–23. The bending mandrel 70 functions to provide a surface for bending a portion of the predetermined length of wire fed from the fixed outlet 19 after formation of the spring body 26 in order to form the second axial toe 24. As best shown in FIGS. 19 and 22, the bending mandrel 70 is positioned with its bending surface 74 above the toe blade bender 60. Bending mandrel 70 includes the bending surface 74, an indent 76, and an adjustment mechanism 77 for a pin 78.

After the toe blade bender 60 is positioned such that blade 68 is inserted into the last formed wrap of spring body 26, the rotational member 66 of toe blade bender 60 is rotated such that the blade 68 forces the spring body to rotate and bend a portion of the predetermined length of wire across bending surface 74 to form the second axial toe 24 having an angle 29 of about 90° with respect to a wrap of the spring body. Preferably, the blade 68 is inserted as described above. However, it is possible to insert the blade in a wrap nearby the last formed wrap and an adjacent wrap to accomplish the same function. The blade is of a thickness such that deformation of the spring body does not occur. The indent 76 of bending mandrel 70 allows for rotation greater than 90°. In the preferred embodiment, an overbend rotation of about 110° is performed such that the elastic properties of the spring which cause some spring back form a bend of about 90°. It should be recognized that various angles can be formed and that the invention is not limited to the listed preferred angles. The rotation is controlled by the spring winding machine under numerical control which switches on and off the air cylinder operatively connected to the rotational member 66. Such rotation of the spring 20 is shown in FIG. 21, wherein spring 20 is first shown in solid marking prior to rotation of rotational member 66 of toe blade bender 60, and shown in broken line for after rotation has occurred.

Pin 78 is operatively mounted on the bending surface of bending mandrel 70 and provides for control of an angle 28 of the spring with respect to an axis through the spring body. Pin 78 holds the spring body 26 in a particular position when the spring body is rotated and the length of wire 14 is bent across the bending surface 74. The pin 78 is movable by the adjustment mechanism 77. Therefore, the pin can be moved in either direction to either slightly increase or decrease the angle of the axial toe with respect to the axis of spring body 26, within a range of about + or −5°.

As indicated above, angle 29 is controlled by the actual amount of rotation of the rotational member of the toe blade bender 60 as discussed above. In the preferred embodiment, the actual bend is about 91°. As discussed above, rotation greater than 90° is allowed by indent 76 so that overbend can be performed to compensate for the elastic qualities of the wire. However, the rotation of the rotational member 66 can also produce a bend of less then 90°. The degree of rotation is controlled by the numerically controlled spring winding machine 12 through the switching of the air cylinder 64 operatively connected to the rotational member 66. After the rotation of the toe blade bender 60, both the toe blade bender 60 and the bending mandrel 70 are withdrawn from their positions with respect to the fixed outlet 19 and the second axial toe has now been completed. Thus, the first axial toe 22 and second axial toe 24 are located at the circumference of the spring and are oriented axially.

The spring winding machine 12 then pulls back a small length of the predetermined length of wire 14 fed from the fixed outlet 19 until a proper length of the second axial toe is achieved; preferably the length being about one tenth (0.1) of an inch, however, the invention is not limited to such preferred length. The wire is then cut by or clipped by clipping tool 80 under numerical control of the spring winding machine 12. The cutting tool 80 includes a knife portion 83 for cutting the wire along the quill surface by fixed outlet 19. After the wire is cut, the spring is caught by a magnetic probe (not shown) and positioned in a chute for transport to a heat treatment oven. Thus, the entire spring 20, including the first axial toe 22 and the second axial toe 24, is formed with tools working around the same fixed outlet 19. As indicated previously, the second axial toe of springs were previously formed by removal of the partially formed spring from the spring winding machine and performing work upon the partially formed spring at an additional machine to complete the bending of a second axial toe. By providing a device which completes the entire spring 20 at one machine eliminates previously performed steps.

The torsion spring of FIGS. 2–5, although being the preferred spring formed by the present invention, is exemplary only. It should be recognized that other springs with a first and second toe can be formed utilizing the ideas of the present invention. For example, an extension spring having curved toes on both ends can also be formed utilizing the present invention by modifying the tools to form an extension spring body and toes projecting axial therefrom with various dimensions and characteristics. Torsion and extension springs of various radiuses can be formed with dimensional variations to the system. For example, the toe bending mandrel could be tooled to have a bending surface of different radii. Therefore, it should be apparent that any number and/or variations of tools could be provided and positioned with respect to the fixed outlet 19 in order to provide and form various desired sizes, shapes and types of spring bodies and toes.

It should also be apparent that the type of wire used may have many variations. For example, a round, rectangular, or barrel cross-sectional structured wires can be used, but the present invention is not limited thereto. Although the present invention is preferably used with thin wire such that bending can be accomplished with air driven cylinders, the thickness of the wire may require the use of other driving means for rotating the several rotational portions of the tools explained above. For example, a thicker wire may require the use of hydraulic cylinders, or high pressure air driven cylinders to allow for bending of thicker wire.

It is to be understood, however, that even though numerous characteristics of the present invention have been set forth in the foregoing description, together with the details of the structure and function of the invention, the disclosure is illustrative and changes in matters of order, shape, size and arrangement of the parts may be made within the principles of the invention and to the full extent indicated by the broad general meaning of the terms in which the appended claims are expressed.

What is claimed is:

1. An apparatus for forming a spring from a wire, said apparatus comprising:

means for feeding said wire from a fixed outlet, said fixed outlet directing said wire in a path;

first means rotating a first bending member for bending a first length of said wire fed from said fixed outlet to form a first generally axial toe;

second means for bending a second length of said wire fed from said fixed outlet to form a spring body;

third means rotating a second bending member for bending a third length of said wire fed from said fixed outlet to form a second generally circumferential, axial toe at a sharp angle with the spring; and means for clipping said wire after the formation of said second generally axial toe.

2. An apparatus according to claim 1, wherein said first bending means includes:

means for wrapping a portion of said first length of wire about a fixed dimensional core to form a first portion of a first wrap of said spring body with a straight leg extending tangentially therefrom; and means for bending said straight leg to form said first generally axial toe.

3. An apparatus according to claim 1, wherein said third bending means includes:

means for inserting an elongated blade between a last formed wrap of said spring body, or a wrap proximate said last formed wrap, and an adjacent wrap; and means for rotating said elongated blade to bend said third length of wire across a bending surface to form said second generally axial toe.

4. An apparatus for forming a spring from a wire, the spring having a spring body and at least one toe, the spring body having a plurality of wraps, said apparatus comprising:

means for feeding said wire from a fixed outlet, said fixed outlet directing said wire in a path;

means for bending a first length of said wire fed from said fixed outlet to form the spring body;

a bending surface; and means rotating a bending member for engaging and rotating the spring body such that a second length of wire fed from said feeding means subsequent to forming the spring body can be sent across the bending surface to form a generally circumferential, axial toe adjacent to said spring body.

5. An apparatus according to claim 4, further comprising means for clipping said wire after said generally axial toe is formed.

6. An apparatus according to claim 4 wherein said engaging and rotating means includes:

means for inserting an elongated blade between a last formed wrap, or a wrap proximate said last formed wrap, and an adjacent wrap; and means for rotating said elongated blade to bend said second length of wire across said bending surface.

7. An apparatus according to claim 6, wherein said bending surface includes a holding surface, wherein a portion of said spring body can rest against said holding surface when said second length of wire is bent across said bending surface to control an angle of said generally axial toe with respect to an axis through said spring body.

8. An apparatus according to claim 7, wherein said holding surface is movable to allow formation of springs having generally axial toes with different angles with respect to the axis through the spring body of each of said springs.

9. An apparatus according to claim 4 further comprising:

means for wrapping a portion of a third length of wire, fed from said fixed outlet prior to formation of said spring body, about a fixed dimensional core to form a first portion of a first wrap of said spring body with a straight leg extending tangentially therefrom; and means for bending said straight leg to form an additional generally axial toe adjacent to said spring body.

10. An apparatus according to claim 9, wherein said wrapping means includes:

a catch member positioned adjacent to said fixed dimensional core to engage said third length of wire; and means for rotating said fixed dimensional core and catch member a predetermined distance to form said first portion of said first wrap of said spring with said straight leg.

11. An apparatus for forming a spring from a wire, the spring having a spring body and at least one toe, the spring body having a plurality of wraps, said apparatus comprising:

means for feeding said wire from a fixed outlet, said fixed outlet directing said wire in a path;

means for bending a first length of said wire fed from said fixed outlet to form the spring body;

a bending surface;

means for engaging and rotating the spring body such that a second length of wire fed from said feeding means subsequent to forming the spring body can be bent across the bending surface to form a generally axial toe adjacent to said spring body;

means for wrapping a portion of a third length of wire, fed from said fixed outlet prior to formation of said spring body, about a fix dimensional core to form a first portion of a first wrap of said spring body with a straight leg extending tangentially therefrom; and means for bending said straight leg to form an additional axial toe to said spring body; wherein said bending means includes:

a slotted member for receiving said first portion of said wrap such that said straight leg is exposed; and means for rotating a bending member positioned adjacent said slotted member such that said straight leg is bent to form said additional generally axial toe.

12. An apparatus for forming a spring from a wire, the spring having a spring body and at least one toe, said spring body having a plurality of wraps, said apparatus comprising:

means for feeding said wire from a fixed outlet;

means for wrapping a portion of a first length of said wire about a fixed dimensional core to form a first portion of a first wrap of said spring body with a straight leg extending tangentially therefrom;

first means rotating a bending member for bending said straight leg to form a first generally circumferential, axial toe adjacent said spring body; and second means for bending a second length of said wire fed from said fixed outlet to form said plurality of wraps of said spring body.

13. An apparatus according to claim 12, wherein said wrapping means includes:

a catch member positioned adjacent to said fixed dimensional core to engage said predetermined length of wire; and means for rotating said fixed dimensional core and said catch member a predetermined distance to form said first portion of said wrap with said straight leg.

14. An apparatus according to claim 12 further comprising:

a bending surface; and means for engaging and rotating said spring body to bend a third length of wire across said bending surface to form a second generally axial toe adjacent said spring body.

15. An apparatus according to claim 14, wherein said engaging and rotating means includes:

means for inserting an elongated blade between a last formed wrap of the spring body, or a wrap proximate said last formed wrap, and an adjacent wrap; and means for rotating said elongated blade to bend said third length of wire across the bending surface to form said second generally axial toe.

16. An apparatus according to claim 14, further comprising means for clipping the wire after said second generally axial toe is formed.

17. An apparatus for forming a spring from a wire, the spring having a spring body and at least one toe, said spring body having a plurality of wraps, said apparatus comprising:

means for feeding said wire from a fixed outlet;

means for wrapping a portion of a first length of said wire about a fixed dimensional core to form a first portion of a first wrap of said spring body with a straight leg extending tangentially therefrom;

first means for bending said straight leg to form a first generally axial toe adjacent said spring body; and second means for bending a second length of said wire fed from said fixed outlet to form said plurality of wraps of said spring body; wherein said bending means includes:

a slotted member for receiving said first portion of said wrap such that said straight leg is exposed;

a bending member positioned generally adjacent to said slotted member; and means for rotating said bending member such that said straight leg is bent to form said first generally axial toe adjacent said spring body.

18. A method for forming a spring from a wire, the spring having first and second generally axial toes and a spring body said method comprising the step of:

feeding the wire through a fixed outlet;

bending by rotating a first bending member a first length of the wire fed the fixed outlet to form the first generally axial toe;

forming the spring body adjacent the first generally axial toe from a second length of the wire fed from said fixed outlet;

bending by rotating a second bending member a third length of the wire fed from said fixed outlet to form the second generally circumferential, axial toe adjacent and at a sharp angle with the spring body; and clipping said wire after the second generally axial toe is formed to separate the spring from a remaining length of the wire.

19. A method for forming a spring from a wire, the spring having first and second generally axial toes and a spring body, said method comprising the steps of:

feeding the wire through a fixed outlet;

bending a first length of the wire fed from the fixed outlet to form the first generally axially toe; wherein said step of bending said first length of wire to form said first generally axial toe includes the steps of:

wrapping a portion of said first length of wire about a fixed dimensional core to form a first portion of a first wrap of said spring body with a straight leg extending tangentially therefrom;

sliding said first portion of said wrap into a slotted member such that said straight leg is exposed; and rotating a bending member across said slotted member to form said first generally axial toe;

forming the spring body adjacent the first generally axial toe from a second length of the wire fed from said fixed outlet;

bending a third length of the wire fed from said fixed outlet to form the second generally axial toe adjacent the spring body; and clipping said wire after the second generally axial toe is formed to separate the spring from a remaining length of wire.

20. A method according to claim 19, wherein said step of bending said third length of wire to form said second generally axial toe includes the steps of:

inserting an elongated blade between a last formed wrap of said spring body, or a wrap proximate said last formed wrap, and an adjacent wrap; and rotating said elongated blade to bend said third length of wire across a bending surface to form said second generally axial toe.

21. A method for forming a spring from a wire, said method comprising the steps of:

forming a spring body from a first length of the wire fed from a fixed outlet, said spring body having a plurality of wraps; and rotating said spring body by rotating a bending member in contact with the wire such that a second length of the wire, fed from said fixed outlet subsequent to forming said spring body, can be bent across a bending surface to form a generally circumferential, axial toe adjacent and at a sharp angle with said spring body.

22. A method according to claim 21 further comprising the step of clipping said wire to separate the spring from a remaining portion of the wire after said generally axial toe is formed.

23. A method according to claim 21, wherein said rotating step further includes the steps of:

inserting an elongated blade between a last formed wrap of said spring body, or a wrap proximate said last formed wrap, and an adjacent wrap; and rotating said elongated blade to bend a portion of said second length of wire across said bending surface to form said generally axial toe.

24. A method according to claim 21 further comprising the steps of:

wrapping a first portion of the first length of the wire fed from said fixed outlet about a fixed dimensional core to form a first portion of a first wrap of said spring body adjacent to a straight leg extending tangentially therefrom; and bending said straight leg to form an additional generally axial toe adjacent said spring body.

25. A method according to claim 24, wherein said wrapping step includes the steps of:

positioning a catch member adjacent to said fixed dimensional core to engage said first portion of said first length of the wire; and rotating said fixed dimensional core and catch member a predetermined distance to form said first portion of said first wrap of said spring body.

26. A method for forming a spring from a wire, said method comprising the steps of:

forming a spring body from a first length of the wire fed from a fixed outlet, said spring body having a plurality of wraps; and rotating said spring body such that a second length of the wire, fed from said fixed outlet subsequent to forming said spring body, can be bent across a bending surface to form a generally axial toe adjacent said spring body;

wrapping a first portion of the first length of the wire fed from said fixed outlet about a fixed dimensional core to form a first portion of a first wrap of said spring body adjacent to a straight leg extending tangentially therefrom; and bending said straight leg to form an additional generally axial toe adjacent said spring body; wherein said bending step includes the step of:

sliding said first portion of said wrap in a slotted member such that said straight leg is exposed; and rotating a bending member positioned adjacent said slotted member to bend said straight leg to form said additional generally axial toe.

27. A method of forming a spring from a wire, said spring having at least one toe and a spring body having a plurality of wraps, said method comprising the steps of:

wrapping a portion of a first length of the wire fed from a fixed outlet about a fixed dimensional core to form a first portion of a first wrap of said spring body and a straight leg extending tangentially therefrom;

bending said straight leg to form a first generally circumferential axial toe adjacent to the first portion of the first wrap; and forming a remaining portion of said spring body from a second length of the wire fed from said fixed outlet adjacent to the first length thereof.

28. A method according to claim 27, wherein said wrapping step includes the steps of:

positioning a catch member adjacent to said fixed dimensional core to engage said first length of wire; and rotating said fixed dimensional core and catch member a predetermined distance to form said first portion of said wrap with said straight leg extending therefrom.

29. A method according to claim 27, further comprising the steps of:

rotating said spring body to bend a third length of wire, fed from said fixed outlet subsequent to forming said spring body, across a bending surface to form a second generally axial toe adjacent said spring body.

30. A method according to claim 29, wherein said rotating step includes the steps of:

inserting an elongated blade between a last formed wrap of said spring body, or a wrap proximate said last formed wrap, and an adjacent wrap; and rotating said elongated blade to bend said third length of wire across the bending surface to form said second generally axial toe.

31. A method according to claim 29, further comprising the step of clipping the wire to separate the spring from a remaining portion of the wire after said second generally axial toe is formed.

32. A method of forming a spring from a wire, said spring having at least one toe and a spring body having a plurality of wraps, said method comprising the steps of:

wrapping a portion of a first length of the wire fed from a fixed outlet about a fixed dimensional core to form a first portion of a first wrap of said spring body and a straight leg extending tangentially therefrom;

bending said straight leg to form a first generally axial toe adjacent to the first portion of the first wrap; wherein said bending step comprises the steps of:

sliding said first portion of said first wrap into a slotted member such that said straight leg is exposed; and rotating a bending member positioned adjacent said slotted member to bend said straight leg to form said first generally axial toe adjacent said spring body and;

forming a remaining portion of said spring body from a second length of the wire fed from said fixed outlet adjacent to the first length thereof.

* * * * *

UNITED STATES PATENT AND TRADEMARK OFFICE

CERTIFICATE OF CORRECTION

PATENT NO. : 5,454,249

DATED : October 3, 1995

INVENTOR(S) : Kempf et al.

It is certified that error appears in the above-identified patent and that said Letters Patent is hereby corrected as shown below:

Col. 12, line 15 "fix" should read --fixed--

Col. 13, line 27 insert --from-- after the word "fed"

Col. 13, line 45 "axially" should read --axial--

Signed and Sealed this

Tenth Day of December, 1996

*Attest:*

*Attesting Officer*

BRUCE LEHMAN

*Commissioner of Patents and Trademarks*